United States Patent [19]

Mussler

[11] Patent Number: 4,733,245

[45] Date of Patent: Mar. 22, 1988

[54] CAVITY-BACKED SLOT ANTENNA

[75] Inventor: Michael E. Mussler, Nederland, Colo.

[73] Assignee: Ball Corporation, Muncie, Ind.

[21] Appl. No.: 877,071

[22] Filed: Jun. 23, 1986

[51] Int. Cl.[4] ..... H01Q 13/18

[52] U.S. Cl. ..... 343/769; 343/789; 343/873

[58] Field of Search ..... 343/705, 708, 767–771, 343/789, 873, 700 MS File, 829, 830

[56] References Cited

U.S. PATENT DOCUMENTS

| | | | |
|---|---|---|---|
| 2,821,708 | 1/1958 | Blancher | 343/768 |
| 3,568,208 | 3/1971 | Hatcher | 343/768 |
| 3,739,386 | 6/1973 | Jones | 343/769 |
| 4,006,481 | 2/1977 | Young et al. | 343/767 |
| 4,132,995 | 1/1979 | Monser | 343/767 |
| 4,367,475 | 1/1983 | Schiavone | 343/767 |
| 4,509,209 | 4/1985 | Itoh et al. | 343/769 |
| 4,600,018 | 7/1986 | James et al. | 343/700 MS |

*Primary Examiner*—William L. Sikes
*Assistant Examiner*—Michael C. Wimer
*Attorney, Agent, or Firm*—Gilbert E. Alberding

[57] ABSTRACT

An electrically-small, cavity-backed slot antenna includes an electrically conductive sheet having an elongated slot contained within the perimeter of the sheet backed by a cavity formed in an electrically conductive housing connected to the sheet. A dielectric layer composed of material having a dielectric constant of ten or greater is coupled to the conductive sheet and overlies the slot so as to effect a reduction of the resonant frequency of the antenna which permits the antenna to be characterized as electrically small. Transmission conductors are electrically coupled to the conductive sheet across the slot and adapted to carry r.f. energy either to or from the sheet depending upon whether the antenna is being used in a transmit or receive mode. For fine tuning the resonant frequency of the antenna, a pair of capacitive elements are mounted across the slot and electrically coupled to the conductive sheet on opposite sides of the slot and at symmetrical loctaions therealong. The elongated slot contained within the perimeter of the conductive sheet can have a configuration in the shape of either a straight line or an unconnected square, circle or triangle.

31 Claims, 7 Drawing Figures

CAVITY-BACKED SLOT ANTENNA

BACKGROUND OF THE INVENTION

1. Field of the Invention

The present invention generally relates to antenna structures and, more particularly, is concerned with a slot antenna backed by an electrically small cavity and tuned to resonance primarily by dielectric loading placed over the slot and secondarily by variable capacitance played symmetrically across the slot which combination results in reduction of the physical size and increase in the gain and efficiency of the antenna.

2. Description of the Prior Art

Cavity-backed slot antennas are well known in the prior art. Traditionally, they are composed of a metal surface backed by an energized resonant cavity and having a slot through which energy is radiated directionally. Representative of the prior art are the cavity-backed slot antennas disclosed in U.S. Pats. Nos. Lindenblad (2,570,824), Fales (2,684,444), Turner (2,863,145), Baldwin (2,885,676), Charman (3,056,130), Harris et al (3,550,141), Monser (4,132,995), Sanford (4,242,685) and Schiavone (4,367,475). As recognized in most of these patents, radiating slot antennas are particularly useful in applications where the antenna must conform to an external surface so as to not interfere with the desired characteristics of the surface. For example, a cavity-backed slot antenna is advantageously used in conjunction with an aircraft wing or fuselage since it will not adversely affect the aerodynamics of the aircraft surface.

The resonant cavity which backs the radiating slot is typically provided on the interior side of the aerodynamic surface in order to limit radiation of energy to the exterior side thereof. To accommodate the cavity there must be unused space available. But, in most applications, interior space is at a premium. Therefore, one basic objective in cavity-backed slot antenna design must be to minimize the physical size of the cavity to the extent feasible without unduly sacrificing the performance characteristics of the antenna.

Various approaches have been proposed in certain of the above-cited patents to limit the physical size of the cavity-backed slot antenna. For instance, bending of the resonant cavity in Fales (U.S. Pat. No. 2,684,444) is proposed to reduce the space occupied by the cavity. In Charman (U.S. Pat. No. 3,056,130), a cavity of a size smaller than normally required for resonance at a given desired frequency is provided. The cavity is tuned to desired resonance by capacitive loading via a baffle located along a longitudinal axis within the cavity. Also, Charman suggests that a small variable capacitance may be provided between the baffle and the bottom of the cavity for the purpose of practical adjustment of the resonant frequency. In Sanford (U.S. Pat. No. 4,242,685), an electrically conductive plate is disposed within the cavity and spaced from all of its internal walls so as to lengthen the effective electrical resonant dimensions of the cavity for a given physical size. The resonant cavity can thus be smaller in size for a given frequency of operation.

The cavity-backed slot antennas of the cited prior art which are identified above as ones concerned with space conversation would appear to operate resonably well and generally achieve their objectives under the range of operating conditions for which they were designed. However, they do provide opportunities for further improvements to be made in terms of reduction of the complexity and constraints they introduced into their antenna designs to achieve the objective of reduced size. Consequently, a need still exists for improvements in cavity-backed slot antenna design which will make size reduction possible without introducing other factors which will diminish antenna performance and increase complexity and cost.

SUMMARY OF THE INVENTION

The present invention provides a cavity-backed slot antenna designed to satisfy the aforementioned needs. An electrically small (non-resonant) cavity is used to restrict radiation to one direction from the slot and the small size permits mounting in areas where space is at a premium. Size reduction of the slot antenna cavity is achieved primarily through use of a high dielectric constant layer placed at the radiating portion of the antenna. The advantage of dielectric loading versus the methods used previously, such as lumped reactance elements, is that it is more efficient at higher frequencies as compared to the other methods of loading.

Small value variable capacitors are employed to permit "fine tuning", that is, to make small resonant frequency adjustments such as might become necessary to compensate for small changes in material properties and dimensions during production. However, "gross tuning" of the antenna, that is, major frequency reduction is accomplished by the layer of dielectric material. Tuning the antenna to resonance for any given cavity size and slot length is achieved primarily by dielectric loading placed over the slot and secondarily by variable capacitance placed symmetrically across the slot. This combination of improvements introduced into a cavity-backed slot antenna results in reduction of the physical size and resonant frequency for any given slot length and cavity size. In addition, the improved antenna exhibits higher gain and efficiency relative to other antennas designed for the same frequency, pattern coverage, polarization and size.

Accordingly, the present invention relates to an antenna which comprises: (a) an electrically conductive sheet having a cavity-backed directionally-radiating elongated slot; (b) a dielectric layer composed of material having a dielectric constant of ten or more coupled to the conductive sheet so as to overlie the slot to effect reduction of the resonant frequency of the antenna; and (c) r.f. transmission means electrically coupled to the conductive sheet across and on opposite sides of the slot and adapted to carry r.f. energy. Further, the antenna includes electrically reactive means mounted across the slot and electrically coupled to the conductive sheet on opposite sides of the slot and being variable for fine tuning the resonant frequency of the antenna.

Also, the present invention is directed to a cavity-backed slot antenna which comprises: (a) an electrically conductive sheet having an elongated slot of a given length formed therein; (b) an electrically conductive housing electrically connected to the conductive sheet and defining a cavity of a given size therein which encloses the slot at one side of the sheet; (c) a dielectric layer composte of material having a high dielectric constant, the dielectric layer being disposed over at least the slot defined in the conductive sheet so as to effect a reduction of the resonant frequency of the antenna below that otherwise associated with the given cavity size and slot length permitting the antenna to be characterized as electrically small; (d) transmission means electrically coupled to the conductive sheet across and on opposite sides of the slot and adapted to carry r.f. energy; and (e) electrically reactive means mounted across the slot and electrically coupled to the conductive sheet on opposite sides of the slot and being adjustable for fine tuning the resonant frequency of the antenna.

More particularly, the high dielectric constant of the dielectric layer is between approximately 10 and 80, and preferably about 20, and the layer has a thickness between about 40 and 80 mils. The depth of the cavity is substantially less than one-quarter wavelength. The elongated slot is contained within the perimeter of the conductive sheet and can have a configuration in the shape of an unconnected square, triangle or circle, or of a straight line.

Still further, the reactive means is in the form of a pair of high Q capacitive elements mounted across the slot and electrically coupled to the conductive sheet on opposite sides of the slot and at symmetrical locations therealong. The capacitive elements are variable for fine tuning the resonant frequency of the antenna. Also, the antenna includes a protective cover of electrically transparent material overlying the dielectric layer. In addition, the conductive sheet includes a dielectric plate composed of material having a dielectric constant of less than three which extends across and is connected to the top of the housing, and an electrically conductive layer covering an interior side of the dielectric plate and electrically contacting the housing. The conductive layer has the slot defined therein so as to be wholly contained within its perimeter.

These and other advantages and attainments of the present invention will become apparent to those skilled in the art upon a reading of the following detailed descriptin when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
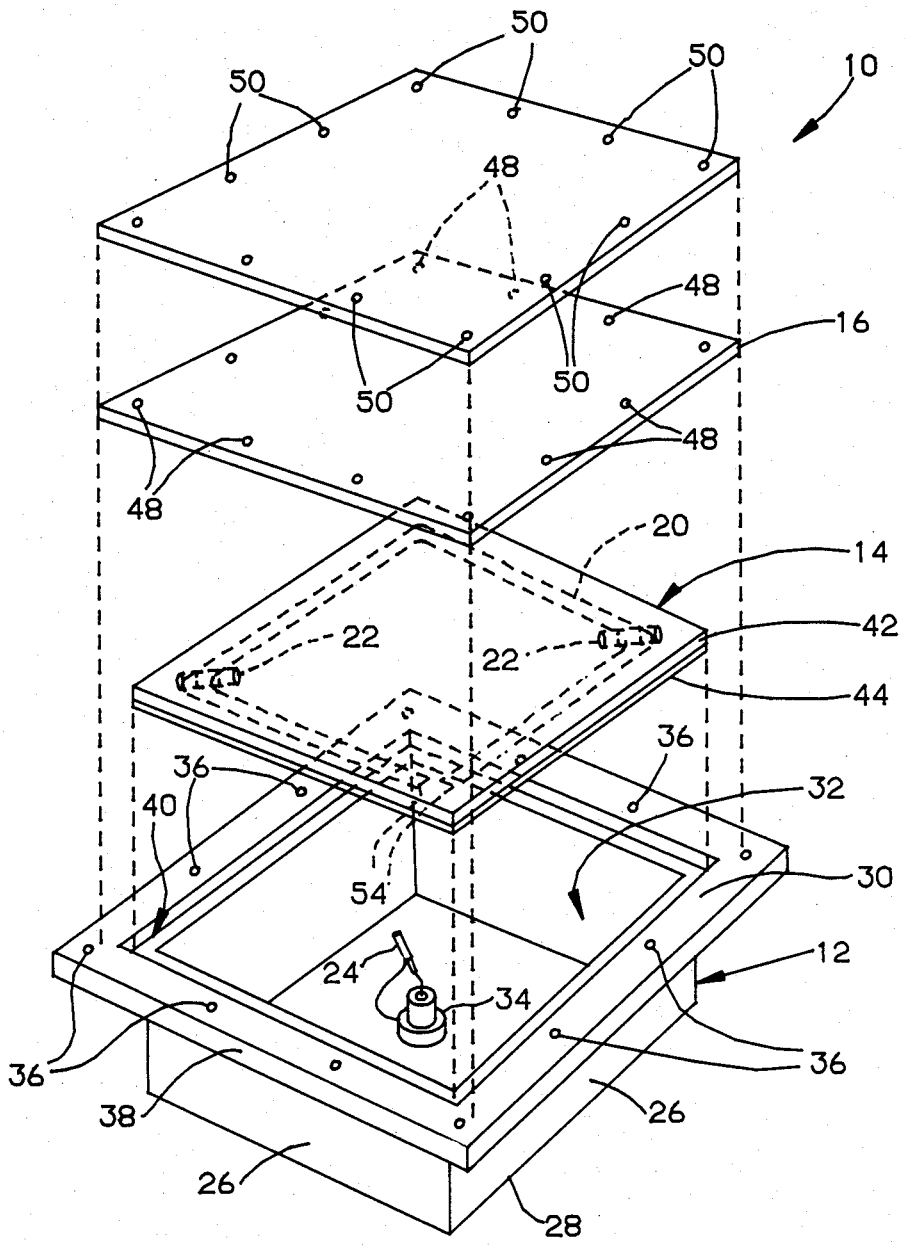
FIG. 1 is an exploded isometric view of a cavity-backed slot antenna incorporating the improvements of the present invention.
Figure 2:
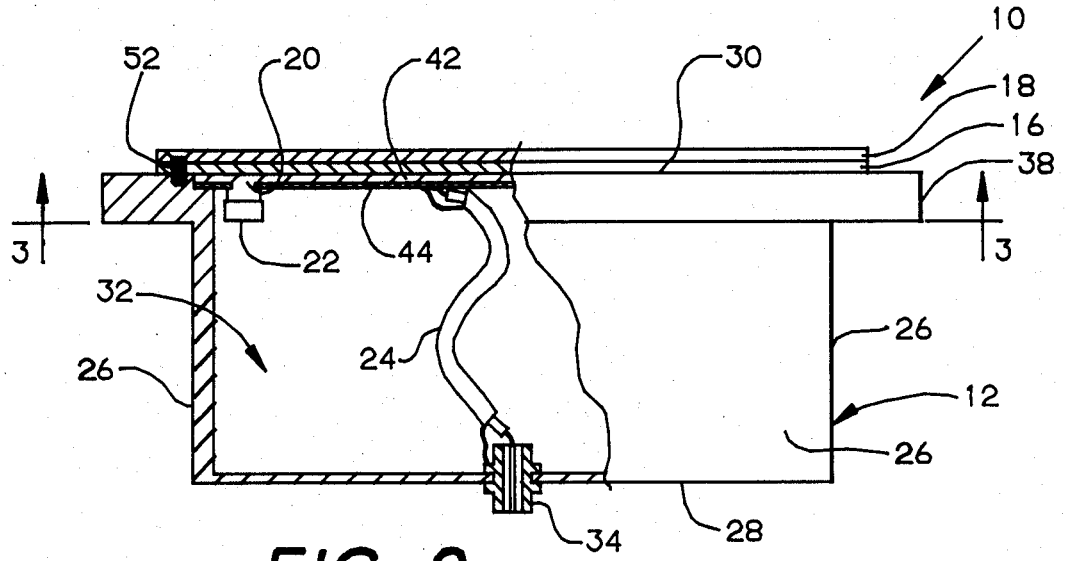
FIG. 2 is a side elevational view, partly in section, of the antenna of FIG. 1.
Figure 3:
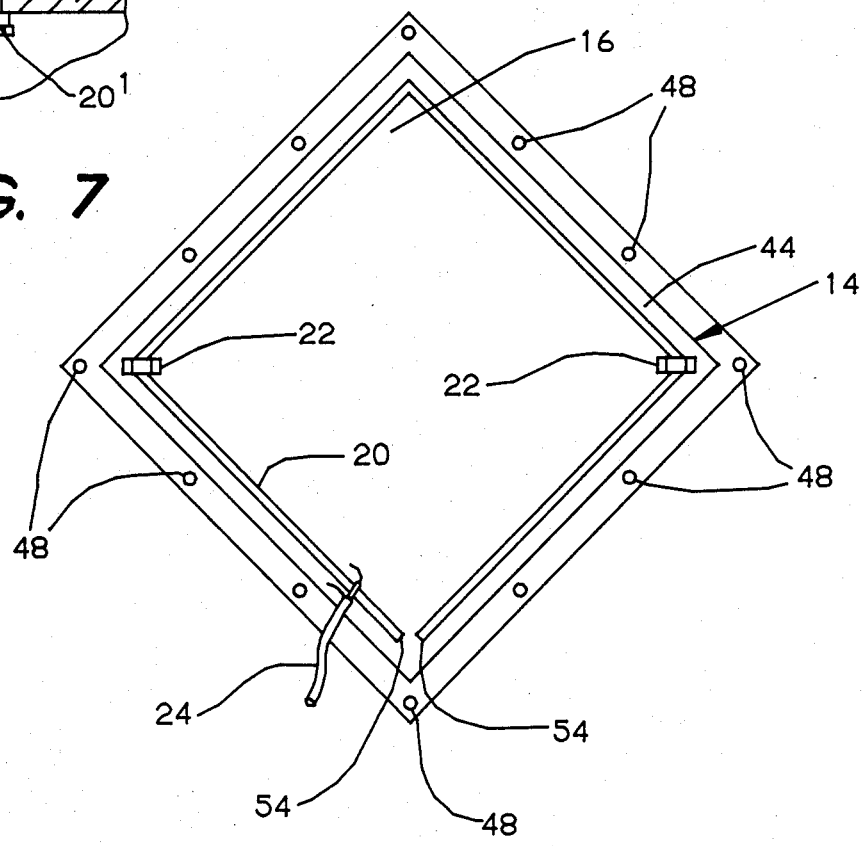
FIG. 3 is a bottom plan view of the cover plate of the antenna as seen along line 3—3 of FIG. 2.

Referring now to the drawings, and particularly to FIGS. 1 to 3, there is shown a cavity-backed slot antenna, generally designated by the numeral 10, having the improved construction of the present invention. The antenna 10 is electrically small and adapted to provide a cardioid-shaped radiating r.f. pattern. As clearly seen in its exploded form in FIG. 1, the antenna 10 includes an electrically conductive housing 12, an electrically conductive sheet in the form of a printed circuit board 14, a dielectric layer 16 and a protective cover 18. Also, a nonconductive slot 20 formed in the p.c. board 14, electrically reactive devices in the form of a pair of variable capacitors 22, and a r.f. transmission line in the form of a coaxial cable 24 are included in the antenna 10.

More particularly, the housing 12, composed of electrically conductive material such as copper or aluminum and fabricated using conventional construction techniques, is rectangular shaped in the embodiment illustrated in FIG. 1, being closed at its side 26 and bottom 28 and open at its top 30 so as to define a cavity 32 of a desired given size therein. Preferably, the cavity 32 has a depth substantially less than one-quarter wavelength. For instance, in one example the depth of the cavity 32 is 0.034 wavelength in free space. The coaxial cable 24 which extends into the cavity 32 is anchored to the bottom 28 of the housing 12 by an r.f. connector 34. A series of internally threaded holes 36 are tapped into an annular mounting flange 38 which extends about the top 30 of the housing 12. The holes 36 are located along and outwardly of an endless recess 40 formed in the flange 38 at its inner edge which bounds the top of the cavity 32.

The p.c. board 14 is dimensioned to snugly fit into the recess 40 in the housing top mounting flange 38. The board 14 includes a dielectric substrate or plate 42 and an electrically conductive layer 44. The dielectric plate 42 is composed of any suitable dielectric material having a dielectric constant of less than three, for example Teflon-Fiberglass material having a dielectric constant of 2.54. The conductive layer 44, for example a copper clad, is formed on the interior side of the plate 42 by any suitable technique, for instance using known photolithography. The conductive layer 44 extends along the interior side of the plate 42 from edge-to-edge so as to make electrical contact about its peripheral edge 46 with the conductive housing 12 when the board 14 is seated in the housing recess 40, as seen in FIG. 2, closing the top of the housing 12 and the cavity 32 formed therein.

In fact, the conductive layer 44 covers the entire bottom or interior side of the dielectric plate 42 except for the elongated slot 20 formed thereon by any suitable conventional technique, such as by etching away the material of the conductive layer 44. In essence, the slot 20 is represented by the absence of conductive material in the desired configuration on interior side of the plate 42. It is not necessary that the slot 20 be formed completely through the p.c. board 14, only that any portion of the board bridging the slot be electrically non-conductive. Since there is no electrically conductive material deposited on the exterior side of the p.c. board 14, the only material bridging the slot 20 is the non-conductive material of the dielectric plate 42. At this point it should be pointed out that while the p.c. board 14 is usefully employed for creating the slot 20, it is not necessary that a p.c. board be used and thus the make-up of the antenna 10 is not so limited. All that is required is to have a slot cut into any good electrical conductor, for instance an aluminum plate or sheet. However, if this is done, some additional support would be required to provide mechanical stability to the center of the metal sheet.

As can be ascertained in FIGS. 1 and 3, the slot 20 is contained within the perimeter of the conductive layer 44 and furthermore enclosed within the top perimeter of the cavity 32 when the p.c. board 14 is seated in the housing recess 40. The unconnected square configuration of the slot 20, depicted in FIGS. 1 and 3, is designed to provide a cardioid-shaped radiation pattern with the polarization parallel to the plane of the slot 20. The electric field vectors across the slot 20 have a sinusoidal amplitude distribution along the slot 20 with minimum amplitude occurring at each end of the slot. In one example, the slot 20 has a length of 0.4 wavelength in dielectric and a width of 0.01 wavelength in dielectric.

The dielectric layer 16 and protective cover 18 have respective holes 48, 50 holes drilled along their peripheral edges for receiving screws 52 to thread into the holes 36 in the housing flange 38 for securing the layer 16 and cover 18 to the top of housing 12. The radome or protective cover 18 is composed of an electrically transparent material, such as a thin sheet of Fiberglass-epoxy or Tefon-Fiberglass, and overlies the dielectric layer 16. The cover 18 can either be separate from the dielectric layer 16, as seen in FIG. 1, or alternatively bonded to its outer side. The dielectric layer 16 is composed of material having a dielectric constant $\epsilon$ of ten or greater, more specifically between ten and eighty and preferably approximately twenty with a permeability $\mu$ of approximately three. Suitable materials for forming the dielectric layer 16 are alumina ceramic, silicone resin/ceramic powder-filled, boron nitride, galium aresnide, aluminum oxide, and cross linked polystyrene/ceramic powder-filled. Also, in iron loaded silicon based material can be used. Other base materials or resins could be used such as epoxy, urethane, foams, etc., with fillers such as carbon/iron, titanium dioxide, and hollow iron spheres to achieve dielectric constants from 10 to 30 or higher with relatively low loss tangeants.

The reduction in the physical size of the antenna cavity 32 for a given resonant frequency is achieved through loading the slot 20 with the relatively high dielectric constant material of the dielectric layer 16. It is the high dielectric constant of the material that directly affects the size reduction of the antenna. The thickness of the dielectric layer 16 depends on the dielectric constant and permeability of the material used, in one example the dielectric layer 16 has a thickness greater than about 30 and between about 40 and 80 mils. The dielectric layer 16 is disposed on the exterior side of the p.c. board 14.

Figure 7:
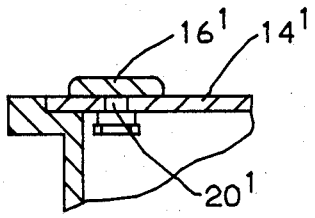
FIG. 7 is a cross-sectional fragmentary view of a modified form of the cavity-backed slot antenna of FIG. 2.

In such position, it is disposed over the slot 20 defined in the conductive layer 44 of the board 14 so as to effect a reduction of the resonant frequency of the antenna below that otherwise associated with the particular given cavity size and slot length. It is this effect which permits the antenna 10 to be characterized as electrically small, that is small or undersized compared to its wavelength dimension and to use a non-resonant cavity 32 to restrict radiation to one direction from the slot 20. As seen in the modified construction of FIG. 7, the dielectric layer 16' need not cover the entire p.c. board 14', but only at least cover the slot 20' formed therein, in the area of highest E field concentration.

Whereas tuning the antenna 10 to resonance, in terms of major reduction of resonant frequency, for a given cavity size and slot length is achieved through loading by the dielectric layer 16, fine adjustment of the resonant frequency is accomplished by the small value, high Q, variable capacitors 22 placed symmetrically across the slot 20. As seen in FIGS. 2 and 3, the capacitors 22 are mounted across the slot 20 and electrically coupled to the conductive layer 44 immediately on opposite sides of slot. The small variable capacitors 22 provide fine tuning of the resonant frequency of the antenna 10 and can be used to compensate for variations in material properties and dimensions from one antenna to the next. The symmetrical location of the capacitors 22 is essential for the desired radiation pattern and polarization.

Excitation and impendance matching is readily achieved through location of the transmission line in the form of coaxial cable 24 across the slot 20 at a point where the slot impedance matches the characteristic impedance of the transmission line, i.e., of the cable. The short circuit across the gap between the two ends 54 of the slot 20 is used to force a low impedance at some point along the slot. The impedance increases sinusoidally either direction away from the short circuit gap and reaches a maximum at the center of the slot length.

In sum, due to above-described improved construction the antenna 10, useful in one application as a marker beacon antenna, exhibits higher gain and efficiency relative to other antennas designed for the same frequency, pattern coverage, polarization and size.

Figure 4:
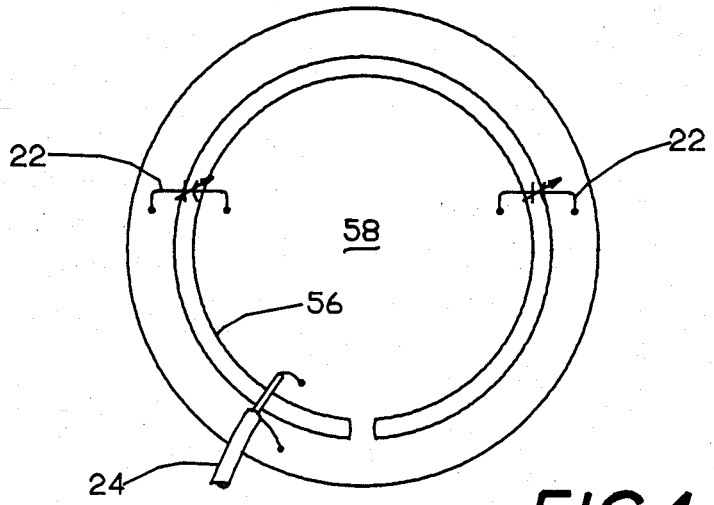
FIG. 4 is a diagrammatic view illustrating an alternative form of the antenna wherein the slot has a circular configuration.
Figure 5:
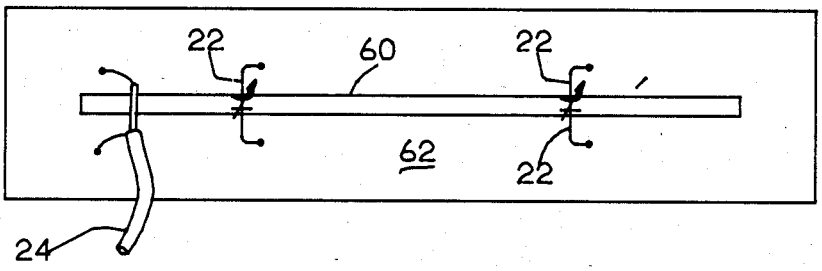
FIG. 5 is a diagrammatic view illustrating another alternative form of the antenna wherein the slot has a linear configuration.
Figure 6:
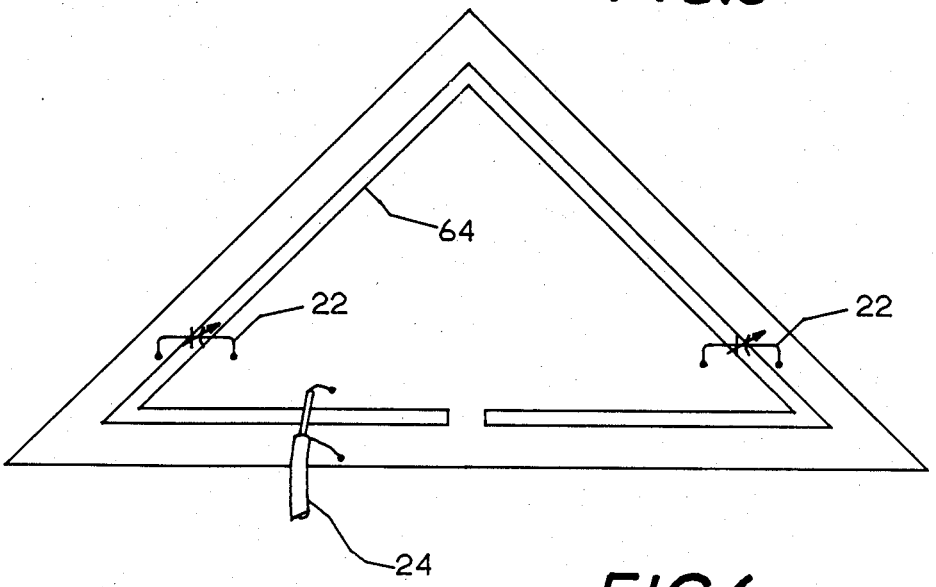
FIG. 6 is a diagrammatic view illustrating yet another alternative form of the antenna wherein the slot has a triangular configuration.

FIGS. 4 to 6 illustrate alternative configurations of the improved cavity-backed slot antenna of the present invention wherein the elongated slot takes other geometric shapes. The variable capacitors 22 and the coaxial cable 24 are the same as in the FIG. 2 embodiment. In FIG. 4, the elongated slot 56 is contained within the perimeter of the conductive layer 58 and has a configuration in the shape of an unconnected circle. In FIG. 5, again the slot 60 is contained within the perimeter of the conductive layer 62 but now has a configuration in the shape of a straight line. Finally, in FIG. 6 the elongated slot 64 is contained within the perimeter of the conductive layer 66 and now has a configuration in the shape of an unconnected triangle.

It is thought that the improved cavity-backed slot antenna of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. An antenna, comprising:

(a) a dielectric substrate having an adherent electrically conductive sheet forming a directionally-radiating elongated slot and means forming a microwave cavity backing said elongated slot;

(b) a dielectric layer composed of material having a dielectric constant of twenty or more overlying said conductive sheet and coupled to said slot to effect reduction of the resonant frequency of said antenna and permit a reduction in the size of the means forming a microwave cavity; and (c) r.f. transmission means electrically coupled to said conductive sheet across and on opposite sides of said slot and adapted to carry r.f. energy.

2. The antenna as recited in claim 1, further comprising:

electrically reactive means mounted across said slot and electrically coupled to said conductive sheet on opposite sides of said slot and being variable for fine tuning the resonant frequency of said antenna.

3. The antenna as recited in claim 2, wherein said reactive means is in the form of a pair of capacitive elements mounted across said slot and electrically coupled to said conductive sheet on opposite sides of said slot and at symmetrical locations therealong, said capacitive elements being variable for fine tuning the resonant frequency of said antenna.

4. The antenna as recited in claim 1, wherein the dielectric layer is composed of an iron-loaded dielectric, and the dielectric constant of said dielectric layer is between approximately 20 and 80.

5. The antenna is recited is claim 1, wherein said dielectric layer has a thickness between about 40 and 80 mils.

6. The antenna as recited in claim 1, wherein said elongated slot is contained within the perimeter of said conductive sheet and has a configuration in the shape of an unconnected square.

7. The antenna as recited in claim 1, wherein said elongated slot is contained within the perimeter of said conductive sheet and has a configuration in the shape of a straight line.

8. The antenna as recited in claim 1, wherein said elongated slot is contained within the perimeter of said conductive sheet and has a configuration in the shape of an unconnected triangle.

9. The antenna as recited in claim 1, wherein said elongated slot is contained within the perimeter of said conductive sheet and has a configuration in the shape of an unconnected circle.

10. A cavity-backed slot antenna, comprising:

(a) an electrically conductive sheet having an elongated slot of a given length formed therein;

(b) an electrically conductive housing electrically connected to said conductive sheet and defining a cavity of a given size therein which encloses said slot at one side of said sheet;

(c) a dielectric layer composed of an iron-loaded dielectric material having a high dielectric constant of about 10 to about 80, said dielectric layer being disposed over at least said slot defined in said conductive sheet so as to effect a reduction of the resonant frequency of said antenna below that otherwise associated with said given cavity size and slot length permitting said antenna to be characterized as electrically small;

(d) r.f. transmission means electrically coupled to said conductive sheet across and on opposite sides of said slot and adapted to carry r.f. energy; and (e) electrically reactive means mounted across said slot and electrically coupled to said conductive sheet on opposite sides of said slot and being adjustable for fine tuning the resonant frequency of said antenna.

11. The slot antenna as recited in claim 10, further comprising:

a protective cover of electrically transparent material overlying said dielectric layer.

12. The slot antenna as recited in claim 10, wherein said conductive sheet includes;

a dielectric plate composed of material having a dielectric constant of less than three, said dielectric plate extending across said housing; and a conductive layer of electrically conductive material covering an interior side of said dielectric plate and electrically contacting said housing, said conductive layer having said slot defined therein so as to wholly contained within the perimeter of said conductive layer.

13. The slot antenna as recited in claim 10, wherein the high dielectric constant of said dielectric layer is about 20.

14. The slot antenna as recited in claim 10, wherein said dielectric layer has a thickness between about 40 and 80 mils.

15. The slot antenna as recited in claim 10, wherein said dielectric layer has a thickness greater than about 30 mils.

16. The slot antenna as recited in claim 10, wherein said cavity has a depth substantially less than one-quarter wavelength.

17. The slot antenna as recited in claim 10, wherein said elongated slot is contained within the perimeter of said conductive sheet and has a configuration in the shape of an unconnected square.

18. The slot antenna as recited in claim 10, wherein said elongated slot is contained within the perimeter of said conductive sheet and has a configuration in the shape of a straight line.

19. The slot antenna as recited in claim 11, wherein said elongated slot is contained within the perimeter of said conductive sheet and has a configuration in the shape of an unconnected triangle.

20. The slot antenna as recited in claim 10, wherein said elongated slot is contained within the perimeter of said conductive sheet and has a configuration in the shape of an unconnected circle.

21. The slot antenna as recited in claim 10, wherein said reactive means is in the form of a pair of capacitive elements mounted across said slot and electrically coupled to said conductive sheet on opposite sides of said slot and at symmetrical locations therealong, said capacitive elements being variable for fine tuning the resonant frequency of said antenna.

22. An electrically-small, cavity-backed slot antenna, comprising:

(a) an electrically conductive housing having a side and bottom and an open top so as to define a cavity of a given size therein;

(b) support means extending across and connected to said housing to close the same and having a conductive portion of electrically conductive material electrically contacting said housing, said conductive portion having an elongated slot of a given length formed therein which is contained within the perimeter of said conductive portion, said elongated slot having unconnected ends and a configuration selected from a group consisting of an unconnected square, unconnected circle, unconnected triangle and straight line;

(c) a dielectric layer composed of material having a dielectric constant of ten or greater, said dielectric layer being attached to said support means and disposed over at least said slot defined in said conductive portion so as to effect a reduction of the resonant frequency of said antenna below that otherwise associated with said given cavity size and slot length permitting said antenna to be characterized as electrically small;

(d) a protective cover of electrically transparent material overlying said dielectric layer;

(e) r.f. transmission means electrically coupled to said conductive portion across said slot and adapted to carry r.f. energy; and (f) a plurality of capacitive elements mounted across said slot and electrically coupled to said conductive portion on opposite sides of said slot and at symmetrical locations therealong, said capacitive elements being variable for fine tuning the resonant frequency of said antenna.

23. The slot antenna as recited in claim 22, wherein the dielectric layer is composed of an iron-loaded dielectric material and the dielectric constant of said dielectric layer is between approximately 10 and 80.

24. The slot antenna as recited in claim 23, wherein the dielectric constant of said dielectric layer is about 20.

25. The slot antenna as recited in claim 22, wherein said material of said dielectric layer is a member selected from the group consisting of alumina ceramic, silicone resin/ceramic powder-filled, boron nitride, gallium arsenide, aluminum oxide, and cross linked polystyrene/ceramic powder-filled.

26. The slot antenna as recited in claim 22, wherein said dielectric layer has a thickness between about 40 and 80 mils.

27. The slot antenna as recited in claim 25, wherein said cavity has a depth substantially less than one-quarter wavelength.

28. The slot antenna as recited in claim 22, wherein said elongated slot is contained within the perimeter of said conductive portion and has a configuration in the shape of an unconnected square.

29. The slot antenna as recited in claim 25, wherein said elongated slot is contained within the perimeter of said conductive portion and has a configuration in the shape of a straight line.

30. The slot antenna as recited in claim 22, wherein said elongated slot is contained within the perimeter of said conductive portion and has a configuration in the shape of an unconnected triangle.

31. The slot antenna as recited in claim 22, wherein said elongated slot is contained within the perimeter of said conductive portion and has a configuration in the shape of an unconnected circle.

* * * * *